US005355644A

United States Patent [19]

Guhl et al.

[11] Patent Number: 5,355,644

[45] Date of Patent: Oct. 18, 1994

[54] ROOF WINDOW-VENTING AND STATIONARY

[75] Inventors: James C. Guhl, Hudson, Wis.; Jürgens R. Martens, Leinfelden-Echterdingen, Fed. Rep. of Germany

[73] Assignee: Andersen Corporation, Bayport, Minn.

[21] Appl. No.: 49,619

[22] Filed: Apr. 19, 1993

Related U.S. Application Data

[63] Continuation of Ser. No. 927,877, Aug. 10, 1992, abandoned, which is a continuation of Ser. No. 747,749, Aug. 20, 1991, abandoned.

[51] Int. Cl.[5] ..... E04B 7/18

[52] U.S. Cl. ..... 52/200

[58] Field of Search ..... 52/233, 200, 208, 716, 52/204

[56] References Cited

U.S. PATENT DOCUMENTS

| | | | |
|---|---|---|---|
| 2,875,710 | 3/1959 | Bechtold | 52/200 X |
| 3,417,522 | 12/1968 | Kiekhaefer | 52/200 |
| 3,434,250 | 3/1969 | Kiekhaefer | 52/200 |
| 3,455,073 | 7/1969 | Kiekhaefer | 52/200 |
| 3,815,285 | 6/1974 | Kuyper | 52/716 X |
| 4,073,097 | 2/1978 | Jentoft | 52/22 |
| 4,139,234 | 2/1979 | Morgan | 52/208 |
| 4,750,302 | 6/1988 | Bechtold | 52/200 |
| 4,776,141 | 10/1988 | Powell | 52/200 |
| 4,788,804 | 12/1988 | Haas | 52/200 |
| 4,807,413 | 2/1989 | Randall | 52/233 |
| 4,823,525 | 4/1989 | Roberts | 52/200 |
| 5,038,537 | 8/1991 | Frambach | 52/204 X |
| 5,103,603 | 4/1992 | Verby | 52/200 X |
| 5,148,643 | 9/1992 | Sampson | 52/200 |
| 5,199,234 | 4/1993 | Guhl | 52/200 |

*Primary Examiner*—Carl D. Friedman
*Assistant Examiner*—Beth A. Aubey
*Attorney, Agent, or Firm*—Merchant, Gould, Smith, Edell, Welter & Schmidt

[57] ABSTRACT

A roof window includes a glass unit and a sash member having an inner surface. The sash member is sized and positioned over a frame, wherein the inner surface of the sash is stacked over and is substantially in alignment with the inner surface of the frame. The window may also include a glass retaining member and shroud operatively connected to the retaining member. Still further, the roof window includes a compression frame gasket and interior gasket.

6 Claims, 8 Drawing Sheets

FIG. 4
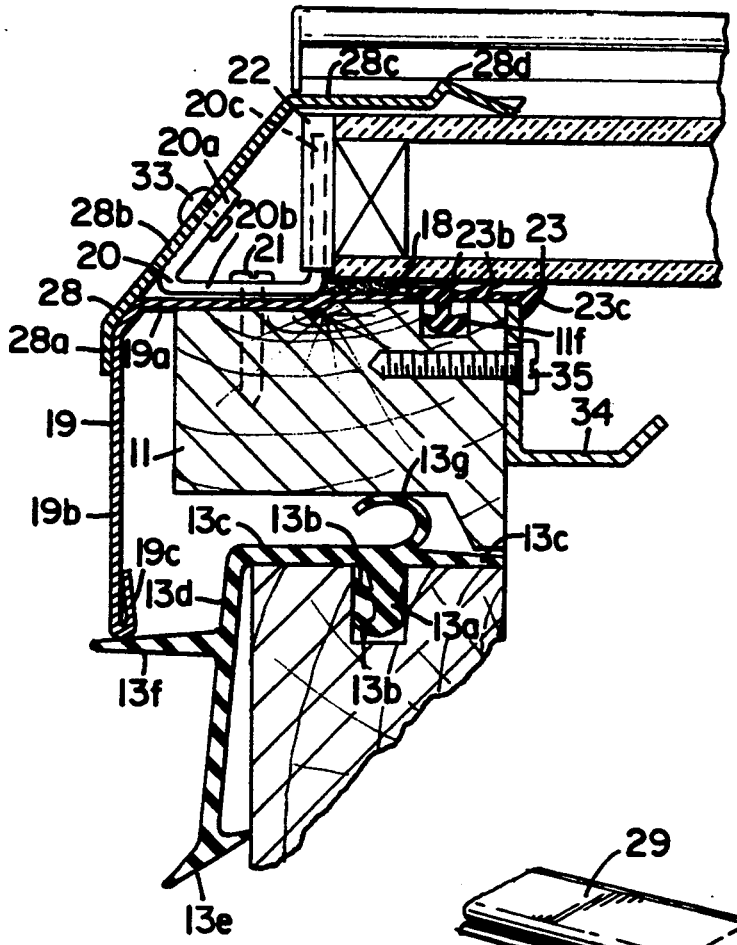
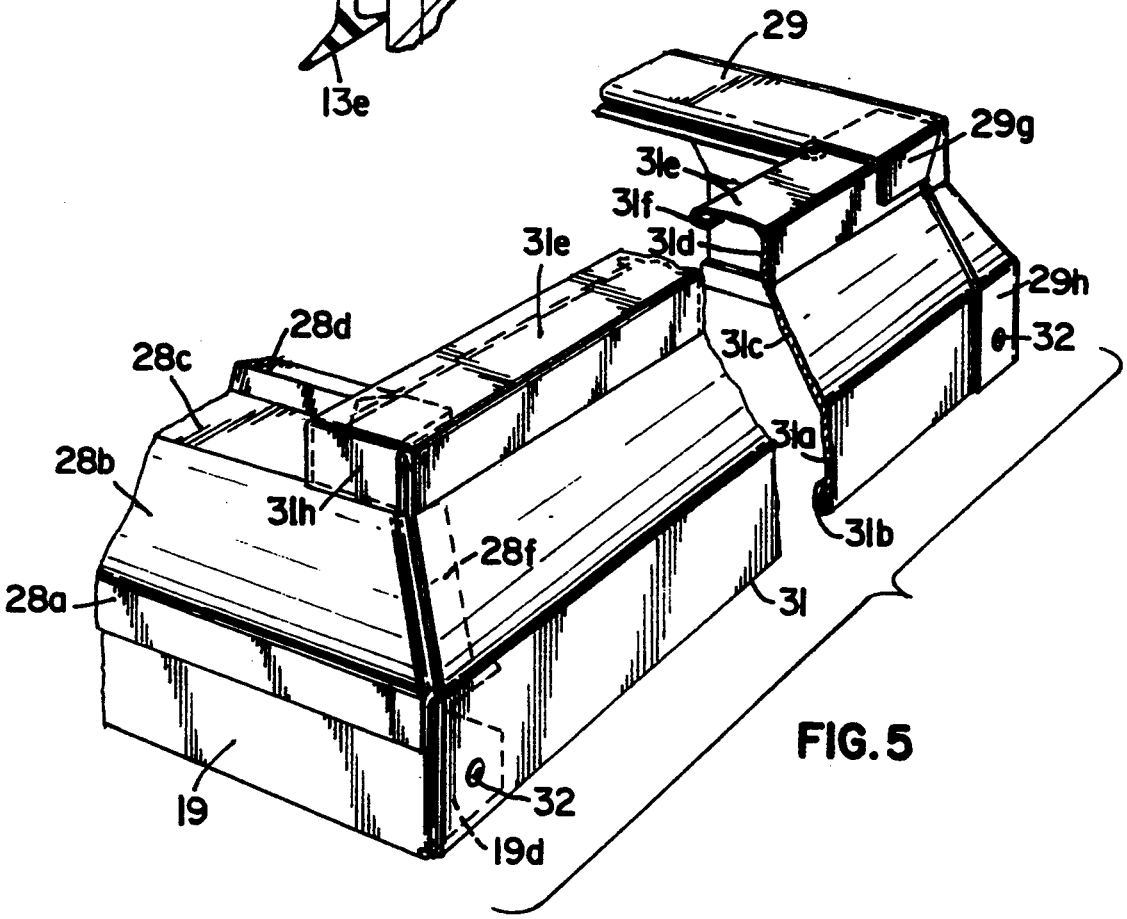
FIG. 5

ROOF WINDOW-VENTING AND STATIONARY

This is a continuation of application Ser. No. 07/927,877, filed Aug. 10, 1992, abandoned Apr. 19, 1993, which is a continuation of application Ser. No. 07/747,749, filed on Aug. 20, 1991, abandoned Aug. 10, 1992.

BACKGROUND OF THE INVENTION

1. Field of the Invention

This invention relates general to roof windows, and more particularly to both stationary and venting roof windows which have a sash and frame which are in substantial alignment and utilize a glass retaining member and shroud member to result in a roof window having an improved aesthetic look as well as improved function.

2. Description of the Prior Art

There are many examples in the prior art dealing with roof window technology for various types and designs of roof windows which have been adapted for different purposes and constructions. While there have been significant advances in roof window technology over the history of roof windows, there are still several problems which have not been satisfactorily resolved.

One example of a prior art skylight is disclosed in U.S. Pat. No. 4,750,302. This skylight does attempt to maximize the amount of glass available for a roof opening through the use of a box-like line and inner and outer frames.

A problem with many prior art roof windows is the use of excessive hardware on either the inside or the outside to spoil the aesthetics of the window. Still further, when designing a roof window, it is important to take into consideration not only the water sealing characteristics, but also air sealing characteristics of the roof window.

The present invention addresses the problems associated with the prior art roof windows and provides for an improved roof window assembly.

SUMMARY OF THE INVENTION

A roof window is configured to be mounted to cover an opening in a structure of a building. The roof window includes a glass unit and a sash member having an inner surface. The glass unit is positioned in the sash member. A frame, which has an inner surface, is operatively connected to the sash by means of a first connecting means. A second connecting means operatively connects the frame to the roof structure. The sash member is sized and positioned over the frame, wherein the inner surface of the sash is stacked over and is substantially in alignment with the inner surface of the frame. In a preferred embodiment, the first connecting means has a first end operatively connected to the sash's outer surface and a second surface operatively connected to the frame's outer surface.

In another embodiment, the invention is a roof window configured to be mounted to cover an opening in a roof structure of a building, the roof window including a glass unit having a top surface and a bottom surface. A sash member has an inner surface and the glass unit is positioned in the sash member. A frame, having an inner surface, is operatively connected to the sash and the frame is also operatively connected to the roof structure. A glass retaining member, having a first end, is operatively connected to the sash and a second end of the glass retaining member is for engaging the top surface of the glass unit. A shroud member has a first end operatively connected to the second end of the retaining member and a second end extending generally outward and downward thereby covering the means for operatively connecting the frame to the sash and the retaining member forming a primary water shed.

In a preferred embodiment, the roof window also includes a compression frame gasket, the frame gasket continuous around the frame and sash. An interior gasket is proximate the bottom of the surface of the glass and the interior gasket is continuous around the sash. An exterior is proximate the top surface of the glass and the exterior gasket is proximate the top and first and second sides of the window.

DESCRIPTION OF THE DRAWINGS

FIG. 4 is an enlarged cross-sectional view of the cross-section shown in FIG. 3.

FIG. 5 is a perspective view of the shroud and retaining members of the roof window shown in FIG. 1.

DETAILED DESCRIPTION OF THE PREFERRED EMBODIMENT

Figure 7:
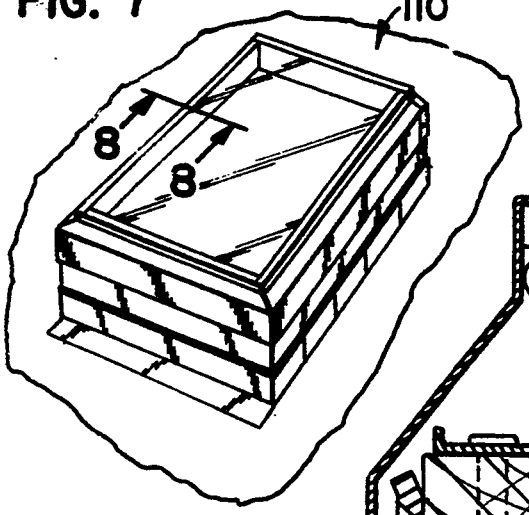
FIG. 7 is a perspective view of the second embodiment of the present invention.
Figure 8:
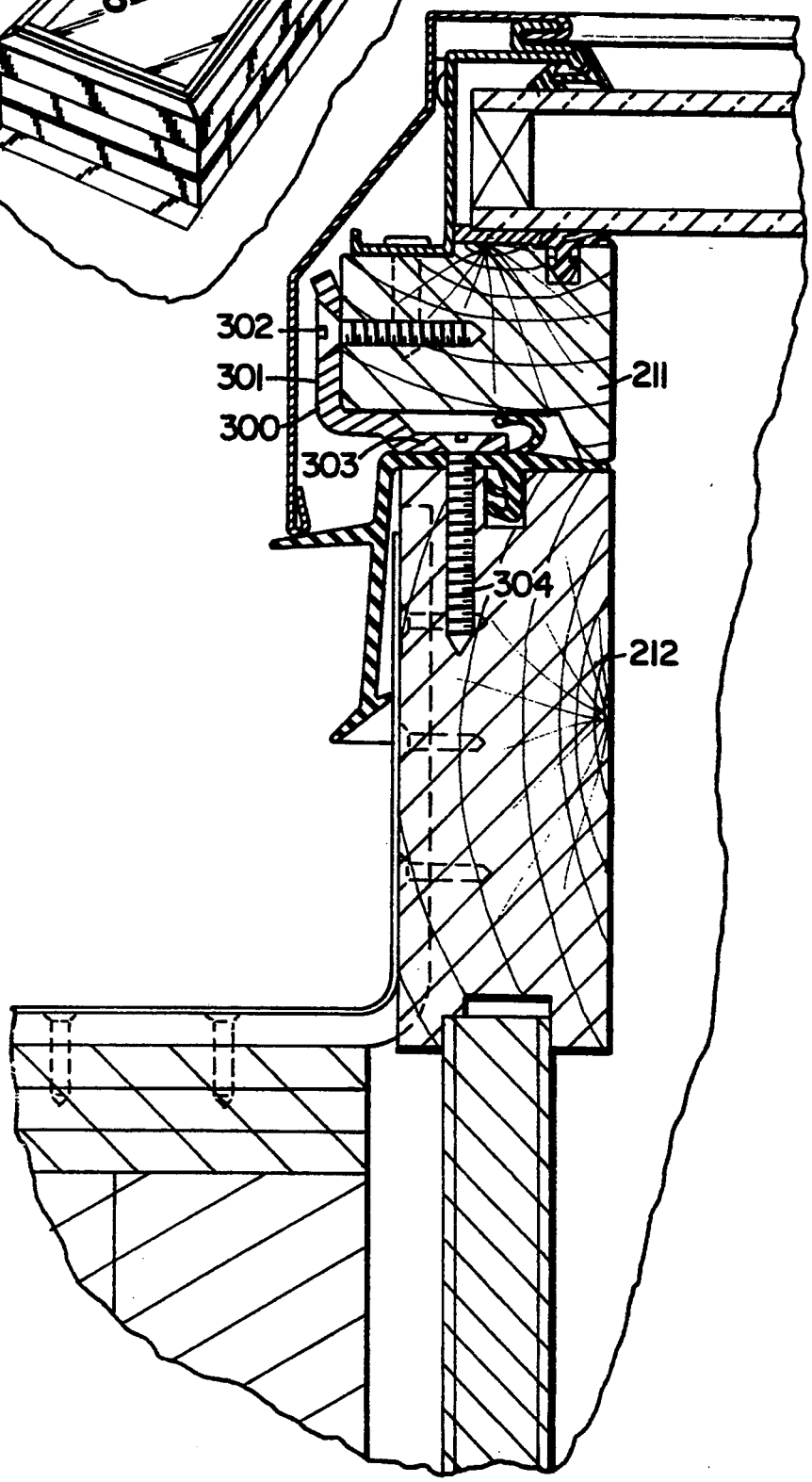
FIG. 8 is a cross-sectional view of the roof window shown in FIG. 7, taken generally along the lines 8—8.

Referring to the drawing, wherein like numerals represent like parts throughout the several views, there is generally disclosed at 10 a roof window. A second embodiment of the roof window generally designated at 110 is shown in FIGS. 7 and 8. Roof window 10 is a venting roof window and roof window 110 is a non-venting roof window. Roof window 10 will be described in detail as roof window 110 is substantially identical to roof window 10, except for the means for connecting the sash to the frame. This difference will be discussed in more detail hereafter.

Figure 1:
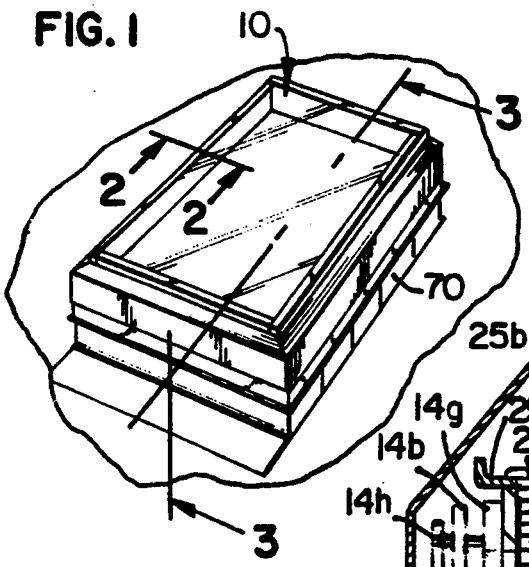
FIG. 1 is a perspective view of a roof window embodying the present invention.

As shown in FIG. 1, the roof window 10 is generally rectangular, however it is understood that other suitable shapes may also be utilized. The roof window 10 includes a wooden sash 11. Four individual wooden members are operatively connected to form the rectangular sash 11 by means well known in the art. The roof window further includes a wooden frame 12 which has four separate wooden members which are operatively connected by means well known in the art to form the frame 12. The sash 11 has an inner surface 11*a* and the frame 12 has an inner surface 12*a*. When assembled, which will be more fully described hereafter, the sash 11 is positioned over the frame 12 such that the inner surface 11*a* of the sash is stacked over and is in substantial alignment with the inner surface 12*a* of the frame 12. This stacking arrangement is clearly shown in FIGS. 2 and 3.

The sash 11 also has a bottom surface 11*b*, top surface 11*c* and outer surface 11*d*. The frame 12 has a bottom surface 12*b*, top surface 12*c* and outer surface 12*d*. The sash 11 has a protrusion 11*e* along its bottom 11*b* thereby forming an opening between the sash 11 and 12 when they are stacked on top of each other. As will be discussed more fully hereinafter, this opening will be utilized to house a gasket and fastening member. On the top surface 12*c*, a gasket receiving cavity 12*e* is formed. This cavity 12*e* is continuous around the top surface of the four members comprising the frame 12.

Figure 2:
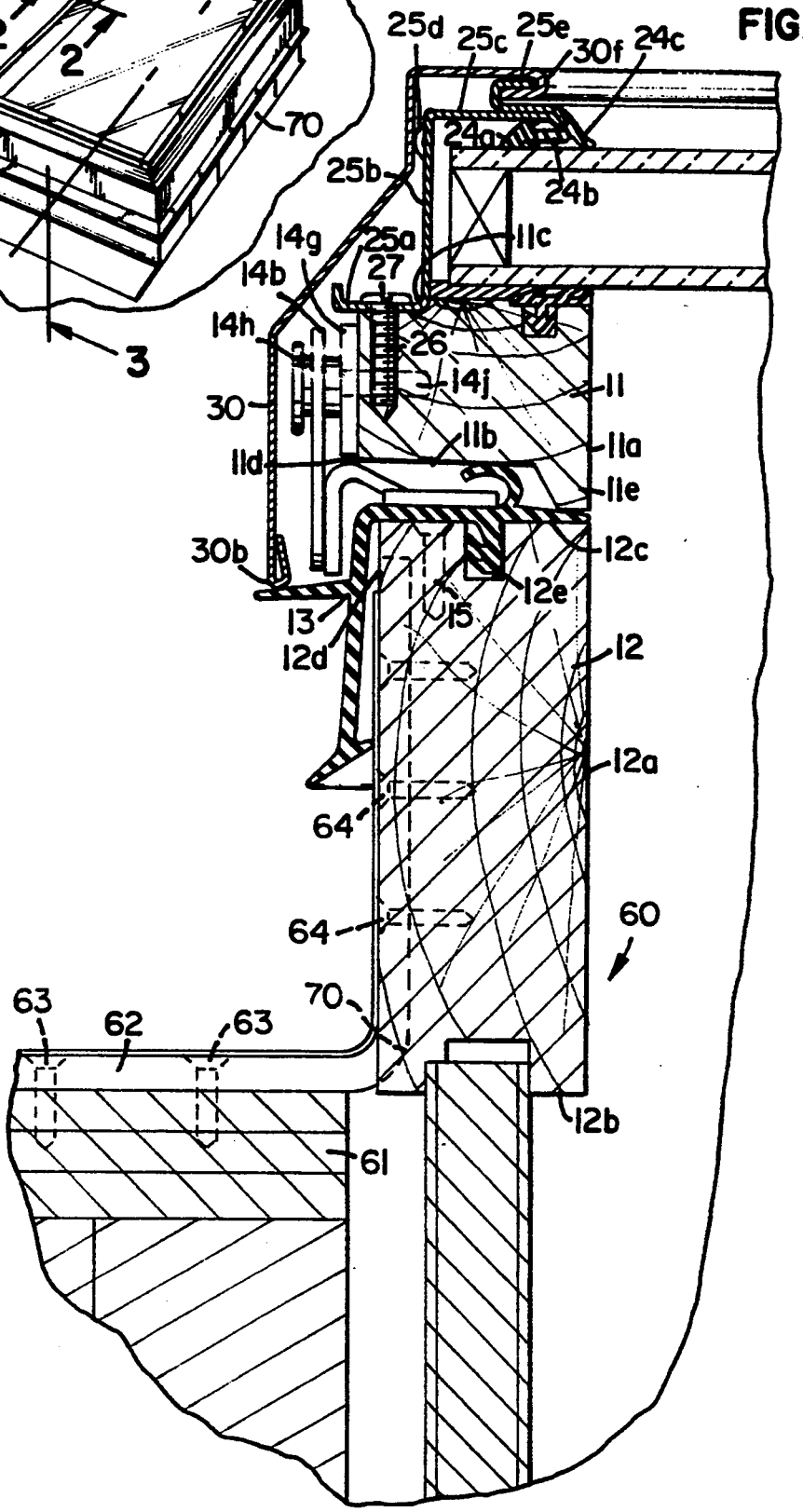
FIG. 2 is a cross-sectional view, taken generally along the lines 2—2 of the roof window shown in FIG. 1 with the hinge lock member removed for clarity.
Figure 3:
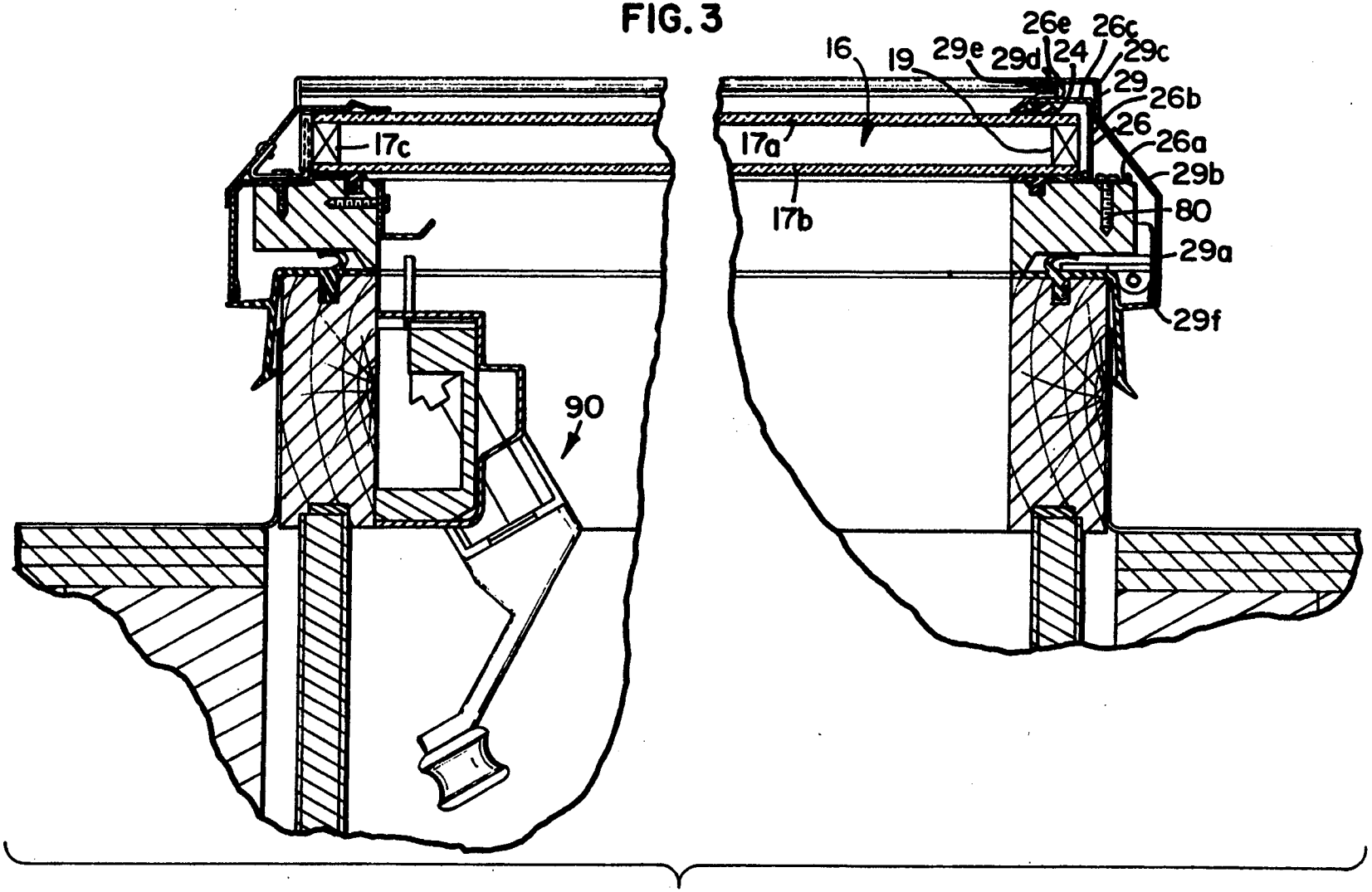
FIG. 3 is a cross-sectional view of the roof window shown in FIG. 1, taken generally along the lines 3—3.
Figure 6:
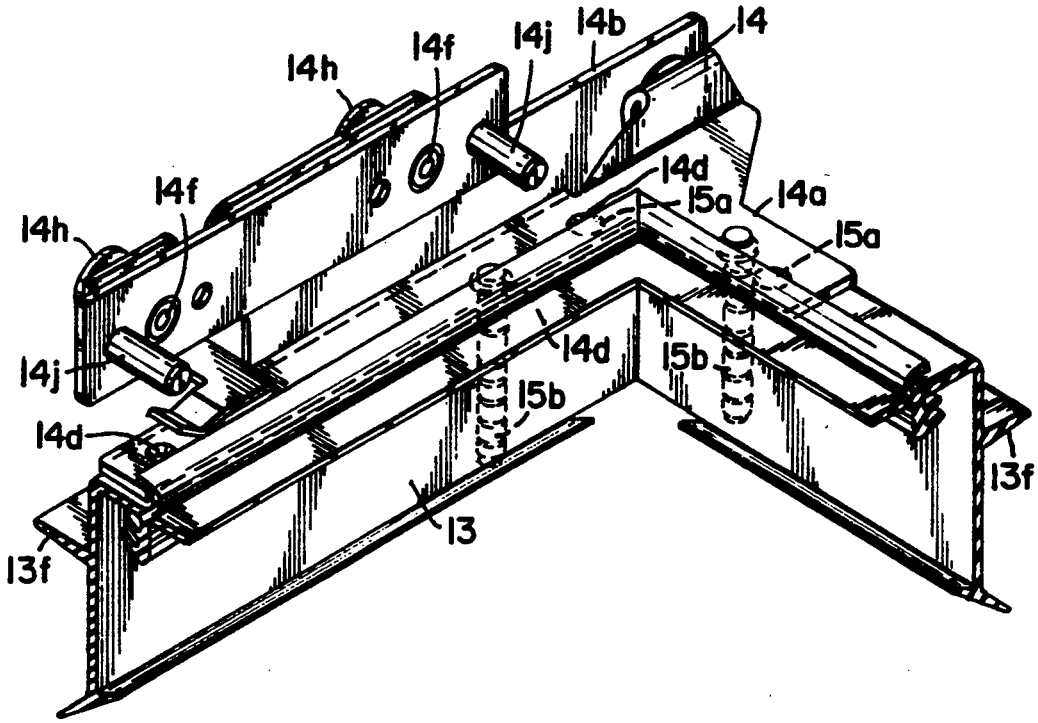
FIG. 6 is a perspective view of the hinge and frame gasket of the roof window shown in FIG. 2.

Before assembling the sash 11 to the frame 12, a compression frame gasket 13 is operatively connected to the frame 12. The compression frame gasket 13 extends continuously around the four sides of the frame 12. A cross-sectional profile of the gasket 13 is shown in FIGS. 2, 3 and 4. Further, a perspective view of the gasket 13 is shown in FIG. 6. The gasket 13 may be made of any suitable material such as EPDM rubber. The frame gasket 13 has a first flange 13*a* which is inserted into the cavity 12*e* of the frame 12. The flange 13 is sized to have a compression fit within the cavity 12*e*. The flange 13*a* has two deformable protrusions 13*b*. The gasket 13 has a top member 13*c* operatively connected to a downwardly depending side member 13*d*. The top member 13*c* is operatively connected to the flange 13*a*. At the bottom of the side member 13*d* is operatively connected a bottom member 13*e*. An outwardly-projecting secondary seal member 13*f* is operatively connected to the side member 13*d*. A C-shaped compression member 13*g* is operatively connected to the top member 13*g* over the first flange 13*a*. In a preferred embodiment, the gasket 13 is formed of one continuous piece and is welded at the four corners to form a continuous gasket.

Figure 9:
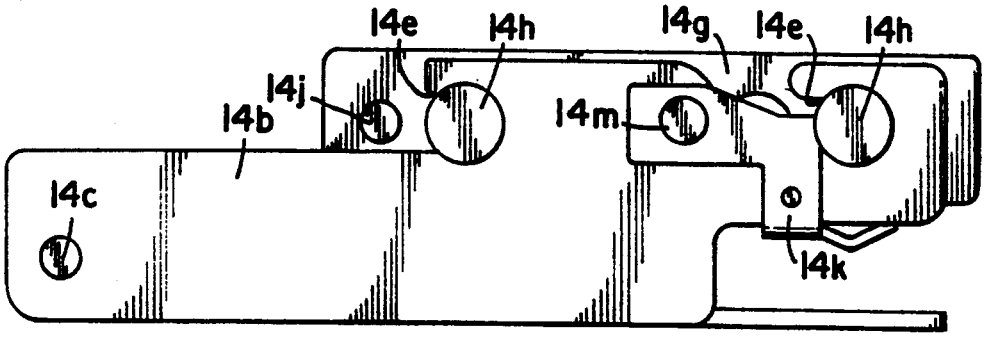
FIG. 9 is a side elevational view of the hinge shown in FIG. 6.

In the first embodiment, a hinge 14 is utilized to operatively connect the sash 11 to the frame 12. The hinge allows the sash to pivot about the hinge and move from a closed position to a venting position. Referring to FIGS. 2, 6 and 9, the hinge 14 has a first bracket 14*a* pivotally mounted to a second bracket 14*b* by means of a pin 14*c*. The first bracket 14*a* has a plurality of holes 14*d* through which screws 15*a* and serrated posts 15*b* may be inserted. There are holes formed in the top member 13*c* of the gasket 13 which are in alignment with the holes 14*d* so that the posts and screws go through not only the bracket 14*a* but also the gasket 13. The bracket 14*a* has two sections. One is for attachment to a side member of the frame 12 and the other is for attachment to a top member of the frame 12. The bracket 14*a* is positioned on the top surface 12*c* of the frame. The second bracket 14*b* has two slotted openings 14*e* configured to receive two posts 14*f* which are operatively connected to a plate 14*g*. The posts 14*f* have an enlarged circular head 14*h*. Also operatively connected, by means well known in the art, are two pins 14*j*. The plate 14*g* is releasable from the second bracket 14*b* and is slidable in the slotted openings 14*e*. A locking arm 14*k* is pivotally mounted to the second bracket 14*b* by means of a pin 14*m*. When the lock 14*k* is in down position, the posts 14*f* are slidable within the slotted opening 14*e*. When the lock is pivoted to the position shown in FIG. 9 the plate 14*g* is locked in position to the bracket 14*b*. In assembling the hinge, the plate 14*g* is removed from the second bracket 14*b* and the pins 14*j* are secured inside of the sash 11 by means well known in the art. The pins may have a simple compression fit into the sash 11. Then, after the first bracket 14*a* has been operatively connected to the frame, the plate 14*g* is slid into the slotted openings 14*e* and locked in position, thereby operatively connecting the sash 11 to the frame 12. It should be noted that the bracket 14*a* is connected to the top surface of the frame and has no exposure to the inner surface 12*a*. Similarly, the plate 14*a* is operatively connected to the outer surface 11*d* and is similarly not exposed to the inner surface 11*a*. In fact, when assembled, no portions of the hinge 14 are visible when looking at the inside surfaces 11*a* and 12*a*. The hinge is also not visible from the outside when the window is closed. A similar hinge is used on the other side of the frame.

A double pane glass unit 16 includes a first pane 17*a* and a second pane 17*b* operatively connected, with dividers 17*c*, by means well known in the art, such double pane glass units are well known and will not be described in further detail.

A bead of silicone sealant 18 is then placed on the top surface 11*c* of the bottom rail of the sash 11. A bottom water shed member 19 is then placed in position on top of the top surface 11*c* and two glass holders 20 are evenly spaced along the bottom rail. There are two glass holders 20 positioned on the bottom and none around the remainder of the sash 11. It is understood that other suitable number of glass holders 20, such as three, may be utilized. A screw 21 is used to operatively connect the glass holders 20 to the sash 11. The bottom water shed member 19 has a top member 19*a* operatively connected to a side member 19*b*. The top member 19*a* is configured to match the top surface 11*c* of the sash 11. As can be seen, there is a slight offset in the top member 19*a* to match the slight offset in the top surface 11*c*. The top member 19*a* extends substantially to a cavity 11*f* which is formed in the top surface of the sash 11. The side member 19*b* has a U-shaped bottom 19*c*. The glass holder 20 is generally triangular in shape and has a first leg 20*a*, bottom leg 20*b*, and upright leg 20*c*. The upper leg 20*c* has a rubber cover 22 operatively connected thereto. The bottom leg 20*b* has a hole through which the screw 21 passes. Further, the side leg 20*a* has a hole formed therein, the purpose of which will be more fully described hereafter. An interior glazing gasket 23 is positioned in the cavity 11*f* on all four sides of the sash 11. The gasket 23 has a cavity engaging member 23*a* which forms a compression fit into the cavity 11*f*. The gasket 23 also includes a plurality of fins 23*b* which engage the second pane 17*b*. Finally, the gasket 23 includes a bottom member 23*c* whose top engages the bottom pane 18 and bottom engages the inner surface 11*a* of the sash 11. Silicone 18 is then placed around the outside of the top glazing gaskets 23. The glazing gasket 23 may be one continuous gasket 23 around the four sides of the roof window or alternately may be four separate segments. The glass unit 16 is then placed on top of the sash 11 and three exterior glazing gaskets 24 are placed in position. The glazing gaskets 24 are positioned along the two sides and top of the roof window 10, but not along the bottom. As both shown in FIG. 2, the exterior glazing gasket 24 has a head segment 24*a*, middle section 24*b*, and bottom section 24*c*.

Figure 10:
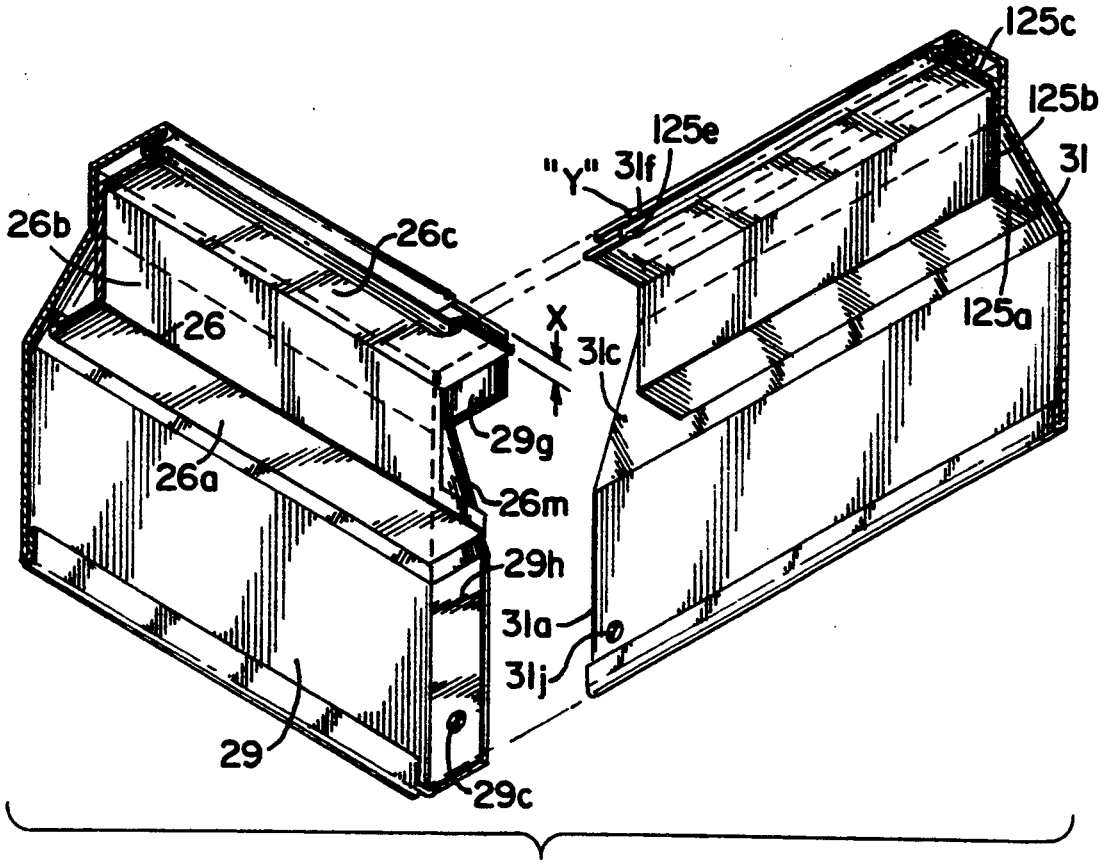
FIG. 10 is an exploded perspective view as viewed from inside the upper right corner of the roof window shown in FIG. 1.

The left glass retainer 25, top glass retainer 26 and right side glass retainer 125 are then operatively connected to the sash 11. The glass retainer 25, as best shown in FIG. 2, includes a bottom member 25*a* having an upward turned end. A hole is formed in the bottom member 25*a* through which a screw 27 is inserted to fasten the retainer 25 to the sash 11. A side member 25*b* is operatively connected to the bottom member 25*a* at one end and to the top member 25*c* at its other end. A dimple 25*d* is formed in the side member 25*b* wherein the dimple acts as a spacer between the shroud and retaining member. The top member 25*c*, at its right end as viewed in FIG. 2, has a downwardly depending portion which turns back and goes across the top member 25*c* and ends in a generally C-shaped section 25*e*. The entire retainer 25 is preferably formed of roll formed aluminum and is in a single piece. The glass retainer 125, as best seen in FIG. 10, is a mirror image of the glass retainer 25 and is used on the right side of the roof window 10. The glass retainer 125 includes a bottom member 125*a* having an upward turned end. While not shown, a hole is formed in the bottom member 125*a* through which a screw (similar to screws 27) is inserted to fasten the retainer 125 to the sash 11. A side member 125*b* is operatively connected to the bottom member 125*a* at one end and to the top member 125*c* at its other end. A dimple (not shown) similar to simple 25*d* is formed in the side member 125*b*. The top member 125*c* has a downwardly depending portion which turns back and goes across the top member 125*c* and ends in a generally C-shaped section 125*e*. The entire retainer 125 is preferably formed of a rolled formed aluminum and is a single piece. The glass retainer 26, as shown in FIG. 3, includes a bottom member 26*a* having an upward turned end. A hole is formed in the bottom member 26*a* through which a screw 80 is inserted to fasten the retainer 26 to the sash 11. A side member 26*b* is operatively connected to the bottom member 26*a* at one end and to the top member 26*c* at its other end. As with the other retainers, a dimple (not shown) is formed in the side member 26*b*. The top member 26*c* has a downwardly depending portion which turns back and goes across the top member 26*c* and ends in a generally C-shaped section 26*e*. The entire retainer 26 is preferably formed of rolled formed aluminum and is a single piece.

Figure 11:
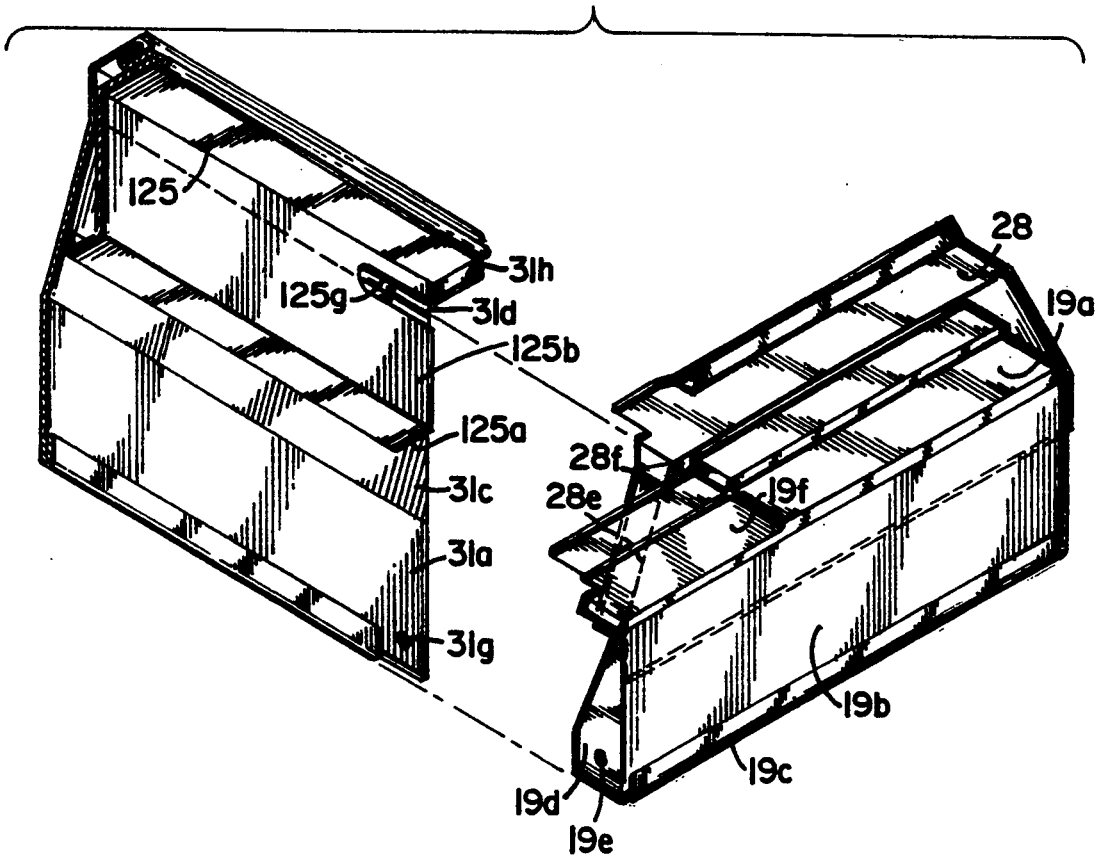
FIG. 11 is an exploded perspective view as viewed from the inside of the lower right of the roof window shown in FIG. 1.
Figure 12:
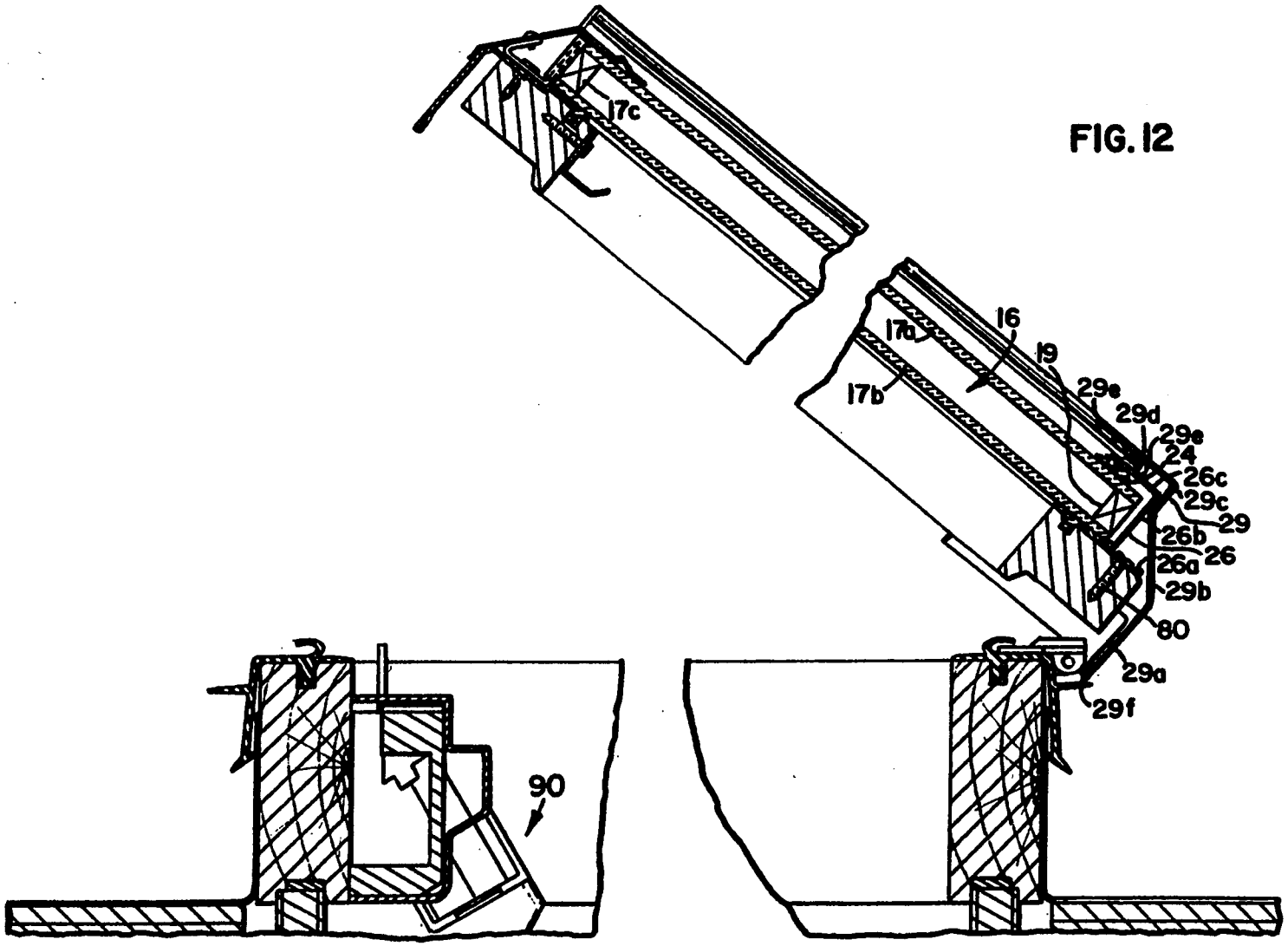
FIG. 12 is a cross-sectional view of the roof window shown in FIG. 1, taken generally along the lines 3—3 with the window shown in an open position.

Previously, the bottom water shed member 19 has been described, with particular reference to its cross-section. In referring to FIG. 11, it can be seen how the end of the water shed member 19 is completed, it being understood that the other end is a mirror image thereof. FIG. 11 is an exploded perspective view as viewed from the inside bottom right corner of the roof window 10. A generally triangular flange 19*d* is formed having a hole 19*e* therein. The flange 19*d* is at a 90° angle to the side 19*b*. The top wall 19*a* is slightly lower at its end and the lower surface 19*f* is generally parallel to but slightly lower that the surface 19*a*. The outer piece 28 which is the bottom shroud is then placed in position. The outer piece 28 is seen in cross-section in FIG. 4 and in FIG. 5 from an outer perspective view and finally in FIG. 11 from an inner perspective view. The outer piece 28 has a bottom segment 28*a* operatively connected to a middle segment 28*b* which is turn operatively connected to a top segment 28*c*. The outer piece is again preferably constructed of a roll formed aluminum as a single piece. The bottom segment 28*a* overlaps the side section 19*b* of the bottom outer shed member 19. A hole is formed in the middle segment 28*b* and is in alignment with the hole which is formed in the side leg 20*a* of glass holder 20. The top segment 28*c* has an end segment 28*d* which is generally L-shaped. At its ends, one of which is shown in FIG. 11 and the other end being similar, the outer piece 28 has the middle section 28*b* cut at a 45° angle and is folded along line 28*e* to form a section 28*f*.

The top outside shroud 29 is then placed in position. The top outside shroud 29 is shown in cross-section in FIG. 3 and in perspective in FIG. 5 and from an inner perspective view in FIG. 10. The shroud 29 is preferably formed from roll formed aluminum as a single piece. Referring to FIG. 3, it can be seen that the shroud 29 has a side member 29*a* operatively connected to a middle member 29*b* which is in turn operatively connected to an upright member 29*c* which is in turn connected to a top member 29*d*. The top member 29*d* has a generally C-shaped end section 29*e*. The side member 29*a* ends in a generally U-shaped section 29*f*. The C-shaped section 29*e* mates with the C-shaped section 26*e* to operatively connect the top glass retainer to the top outside shroud. As can be seen in FIGS. 5 and 10, the top outside shroud has a downwardly depending end flange 29*g* and a corner flange 29*h*. The corner flange 29*h* has a hole formed therein for acceptance of a rivet. The top glass retainer 26 has an L-shaped cutout in its side member 26*b* forming a ledge 26*m* on which the bottom member 125*a* rests. There is a spaced labeled "X" in FIG. 10 which is between the bottom surface of the top member 29*d* and the upper surface of the top member 26*c*. This forms an opening into which the right glass retainer's top member 125*c* is positioned.

A bead of a suitable silicone (not shown), used as a sealant, is then placed on all four corners where a lap joint will be formed. The left shroud 30 and right shroud 31 are then placed in position and operatively connected to their respective glass retainers, as will be more fully described hereafter. The right shroud 31 is a mirror image of the left shroud 30. A cross-sectional view of the left shroud 30 is shown in FIG. 2. A perspective view of the right shroud 31 is shown in FIGS. 5, 10 and 11. The right shroud 31 has an upright portion 31*a* which has a U-shaped end 31*b*. The U-shaped end 31*b* is shown in FIG. 5, but it is more clearly seen when viewing the comparable U-shaped portion 30*b* of the left shroud 30 seen in FIG. 2. An intermediate portion 31*c* is operatively connected to the upright portion 31*a* and also to the top upright portion 31*d*. The upper portion 31*e* is operatively connected to the top portion 31*d* and has a C-shaped end 31*f*. Again, the C-shaped end is more easily seen in FIG. 2 when compared to the C-shaped end 30*f* of the left shroud 30.

Referring to FIGS. 5 and 11, the lower end of the right shroud 31 will be described in detail, it being understood that the lower end of the left shroud 30 is a mirror image thereof. The upright portion 31*a* has a hole 31*g* formed therein proximate the bottom. The intermediate portion 31*c* is cut at an angle, approximately 45°, and then meets with the top upright portion 31*d*, which when viewed in FIG. 11 is hidden from view by the right glass retainer 125, except for that seen through the slot 125*g*. Because of the perspective view of FIG. 11, the angle of the end of portion 31*c* is not as noticeable. However, it is at approximately 45° so that portion 31*a* extends out further than portion 31*c*. A tab 31*h* is formed and is 90° to the upper portion 31*e* and depends generally downward therefrom. The end of the right glass retainer 125 has a slot 125*g* at the end of the side member 125*b*.

Referring now to FIG. 10, which shows an inner perspective view of the right shroud at the upper right corner, it can be seen that the upright portion 31*a* has a hole 31*j* formed therein. The intermediate portion 31*c* is cut at its end at approximately a 45° angle. The C-shaped end 31*f* terminates at point Y. Similarly, the C-shaped end 125*e* also terminates at point Y. This creates a gap between the top portion 31*d* and the top member 125*c*.

The C-shaped members on both the shrouds and glass retainers allow for the components to be either slid together or rolled together to form a connection. As can be seen in FIG. 5, when the corners are in position, a lap joint is formed between the adjacent shrouds. Pop rivets 32 are shown in FIG. 5 and go through holes 31*g* and 19*e* at the bottom and 31*j* and 29*i* at the top. Further, two rivets 33 are inserted through the outer piece 28 and the glass holders 20 for securing the two together. Because of the construction described, only the six rivets are seen from the outside. Further, no hardware is seen from the inside of the building where the roof window 10 would be installed. A condensation channel 34 is fastened by means of screw 35 across the bottom of the roof window 10 and is fastened to the inside surface 11*a* of the sash 11.

The roof window 10 is configured to cover an opening 60 in a roof structure 61. Ninety degree brackets 62 have a first leg which is operatively connected to the roof structure 61 by means of screws 63 and a second leg which is operatively connected to the frame 12 by means of screws 64. A recess 70 is formed in the frame member 12 so that the second leg of the angle bracket 62 does not extend beyond the frame member itself. This provides for a flush mounting of the angle brackets so that it does not protrude from the frame member 12. During installation, flashing is positioned along the outside surface of the frame member 12 underneath the bottom member 13*e* which is a flashing engagement member. The flashing is not shown in FIG. 2, but is generally shown in FIG. 1 as 70.

An operator, generally designated at 90, is shown in FIG. 3. The operator 90 is for use in opening and closing the venting roof window 10. The details of the operator 90 and the connection to the roof window 10 are not shown as this is well known in the art how to construct such operators. One such operator is disclosed in co-pending U.S. application Ser. No. 07/619,113 filed Nov. 28, 1990 entitled "Counter Balanced Window Operators", such application hereby incorporated by reference.

A second embodiment is shown in FIGS. 7 and 8. This second embodiment is a non-venting roof window as opposed to the venting window previously described. The embodiment will not be described in detail and is not shown in further detail other than in FIGS. 7 and 8 because the difference with the second embodiment to the first embodiment is that the second embodiment uses a bracket 300 for connecting the sash 211 to the frame 212 instead of the hinge 14. The bracket 300 has a first leg 301 which is operatively connected to the sash 211 by means of screw 302. A second leg 303 is substantially 90° from the first leg 301 and the second leg 303 is operatively connected to the top surface of the sash 312 by means of screw 304. The bracket 300 is a rigid bracket and in conjunction with the screws 302 and 304 securely secure the sash 211 to the frame 212.

The foregoing described invention has a number of advantages. By having the sash 11 stacked on top of the frame 12 such that their inner surfaces 11*a* and 12*a* are flush, a maximum amount of light is available. There is no obstruction to the glass unit by the sash protruding inside of the frame. Further, by having this stacked arrangement, a good weatherseal arrangement is available in that the compression member 13*g*, which is generally C-shaped, is compressed by the stacked arrangement and provides for a good weatherseal between the sash and the frame. The sash 11 and frame 12 are preferably constructed of wood and provides for a very clean, good looking, clear wood interior all the way around. Because of the arrangement of the securing of the sash 11 to the frame 12, there is no exposed hardware on the interior surface, except for the condensation channel.

The shrouds 29–31, as well as outer piece 28, the right glass retainer 125, left glass retainer 25 and top glass retainer 26 and finally the bottom water shed member 19 are formed from rolled formed aluminum parts. The roll formed aluminum parts allow for a number of advantages. The first is that it allows lap joints to be achieved between the parts that allows for an excellent seal with silicone sealant between the lap joints to be formed. It also provides for a natural-like gravity water shed from one part over the top of the other parts. So it is an excellent way of water shedding the shrouds. Another distinct advantages of the roll formed design is that the hardware that attaches the aluminum to the wood underneath is achieved in one of the roll formed parts (the glass retainer 25 and 125) and then another roll form part (shrouds 30 and 31) snap in and slide in place over so as to conceal the fasting hardware and the only exposed fasting hardware is the rivet at the four corners and the rivets through the glass holders 20. By having two interlocking C-shaped members, the shrouds and retainers are able to be snapped together and then slid into place, again achieving a lap-type joint.

The gasketing system for this window is also unique. The three exterior glazing gaskets 24 (around the top and sides, but not the bottom) provides for a water shed over the shrouds 29–31, but not necessarily the outer piece 28. Preferably, the glazing gaskets 24 are one continuous gasket which is notched to fit all three sides. Proximate the bottom, the water may be shed either over or under the outer piece 28. However, if the water does go underneath, the bottom water shed member 29 provides for a water shed away from the glass. As can be seen in FIG. 4, the silicone 18 and gasket 23 will prevent the water from entering under the glass unit. The compression frame gasket 13, in addition to providing for an excellent weather seal with the use of the compression member 13*g*, also provides for a secondary air seal. This secondary air seal is formed around the four sides of the roof window with the combination of the secondary seal member 13*f* contacting the U-shaped bottom 19*c* on the bottom and contacting U-shaped ends 30*a* and 31*b*, as well as the U-shaped end 29*f*. This secondary air seal forms a pocket of air to further insulate and provide for a pressure equalization chamber for the roof window 10.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

We claim:

1. A roof window having a top, bottom and two sides, said roof window configured to be mounted to cover an opening in a roof structure of a building, said roof window comprising:

(a) a glass unit;

(b) a sash member having an inner surface, said glass unit positioned in said sash member;

(c) a frame, having an inner surface having a top and bottom surface;

(d) first means for operatively connecting said frame to said sash said first means comprises:

(i) said sash having a non-inner surface;

(ii) said frame having a non-inner surface; and (iii) said first connecting means having a first end operatively connected to said sash's non-inner surface and a second end operatively connected to said frame's non-inner surface, wherein said first means is concealed from view from inside;

(e) second means for operatively connecting said frame to the roof structure;

(f) said sash member sized and positioned over said frame, wherein said inner surface of said sash is stacked over and is substantially in alignment with said inner surface of said frame;

(g) a glass retaining member having a first end operatively connected to said sash and a second end for engaging said top surface of said glass unit; and (h) a shroud member having a first end operatively connected to said second end of said retaining member and a second end extending generally outward and downward thereby covering said means for operatively connecting said frame to said sash and said retaining member forming a primary watershed and also concealing said first means from view from outside, wherein said retaining member and shroud member are positioned on said window's top and two sides, further wherein said retaining member and shroud are formed from roll formed aluminum and lap joints are formed between said top and sides, still further wherein said retaining member has a C-shaped end section and said shroud has a C-shaped end section, whereby said C-shaped sections have a sliding fit, wherein additional outside hardware is minimized.

2. The roof window of claim 1, wherein said first connecting means is a hinge.

3. The roof window of claim 1, wherein said first connecting means is a rigid bracket.

4. A roof window configured to be mounted to cover an opening in a roof structure of a building, said roof window comprising:

(a) a glass unit;

(b) a sash member having an inner surface, said glass unit positioned in said sash member;

(c) a frame, having an inner surface having a top and bottom surface;

(d) first means for operatively connecting said frame to said sash said first means comprises:

(i) said sash having a non-inner surface;

(ii) said frame having a non-inner surface; and (iii) said first connecting means having a first end operatively connected to said sash's non-inner surface and a second end operatively connected to said frame's non-inner surface, wherein said first means is concealed from view from inside;

(e) second means for operatively connecting said frame to the roof structure;

(f) said sash member sized and positioned over said frame, wherein said inner surface of said sash is stacked over and is substantially in alignment with said inner surface of said frame;

(g) a glass retaining member having a first end operatively connected to said sash and a second end for engaging said top surface of said glass unit, said retaining member further having a protrusion formed on its exterior; and (h) a shroud member, wherein said protrusion acts as a spacer between said shroud and retaining member, further wherein said shroud member has a first end operatively connected to said second end of said retaining member and a second end extending generally outward and downward thereby covering said means for operatively connecting said frame to said sash and said retaining member forming a primary watershed and also concealing said first means from view from outside.

5. The roof window of claim 4, wherein said first connecting means is a hinge.

6. The roof window of claim 4, wherein said first connecting means is a rigid bracket.

* * * * *